US010364807B2

(12) United States Patent
Fink

(10) Patent No.: US 10,364,807 B2
(45) Date of Patent: Jul. 30, 2019

(54) METHOD AND DEVICE FOR ACTUATING AN ELECTRICALLY COMMUTATED FLUID WORKING MACHINE

(71) Applicant: Danfoss Power Solutions GmbH & Co. OHG, Neumunster (DE)

(72) Inventor: Sven Fink, Linden (DE)

(73) Assignee: Danfoss Power Solutions GmbH & Co. OHG, Neumunster (DE)

( * ) Notice: Subject to any disclaimer, the term of this patent is extended or adjusted under 35 U.S.C. 154(b) by 745 days.

(21) Appl. No.: 14/430,751

(22) PCT Filed: Sep. 23, 2013

(86) PCT No.: PCT/DE2013/100340

§ 371 (c)(1),
(2) Date: Jun. 25, 2015

(87) PCT Pub. No.: WO2014/048418

PCT Pub. Date: Apr. 3, 2014

(65) Prior Publication Data

US 2015/0345489 A1 Dec. 3, 2015

(30) Foreign Application Priority Data

Sep. 26, 2012 (DE) ..... 10 2012 109 074

(51) Int. Cl.
*F04B 1/06* (2006.01)
*F04B 7/00* (2006.01)
*F04B 49/06* (2006.01)

(52) U.S. Cl.
CPC ..... *F04B 7/0076* (2013.01); *F04B 1/06* (2013.01); *F04B 49/065* (2013.01)

(58) Field of Classification Search
CPC ..... F04B 49/065; F04B 1/0452; F04B 1/053; F04B 1/06; F04B 7/0076; F04B 2207/00
(Continued)

(56) References Cited

U.S. PATENT DOCUMENTS 5,277,553 A 1/1994 Stolpp
7,762,787 B2 * 7/2010 Kawakami ..... F04B 49/02 239/526

(Continued)

FOREIGN PATENT DOCUMENTS

DE 10 2008 064 408 A1 6/2010
EP 0 494 236 B1 12/1995

(Continued)

OTHER PUBLICATIONS

International Search Report for PCT Serial No. PCT/DE2013/100340 dated Jan. 21, 2014.

*Primary Examiner* — Charles G Freay
(74) *Attorney, Agent, or Firm* — McCormick, Paulding & Huber LLP

(57) ABSTRACT

The invention relates to a method for actuating an electrically commutated fluid working machine (1), wherein the actuation of the electrically controllable valves (11) of the electrically commutated fluid working machine (1) is effected dependent on the fluid requirement and/or mechanical power requirements. In addition, on actuation of the electrically controlled valves (11) the electrical power required for actuating the electrically controllable valves is taken into account.

21 Claims, 2 Drawing Sheets

(58) Field of Classification Search
USPC ..... 417/44.11, 411, 213, 297–298
See application file for complete search history.

(56) References Cited

U.S. PATENT DOCUMENTS

| | | | | |
|---|---|---|---|---|
| 8,348,627 | B2 * | 1/2013 | Rampen | F03C 1/0447 417/139 |
| 8,651,827 | B2 * | 2/2014 | Usui | F02M 59/366 123/455 |
| 2008/0206066 | A1 * | 8/2008 | Nguyen | F04B 9/12 417/46 |
| 2010/0076670 | A1 | 3/2010 | Turner et al. | |
| 2010/0303638 | A1 | 12/2010 | Kuttler et al. | |
| 2011/0253918 | A1 | 10/2011 | Rampen et al. | |
| 2011/0268588 | A1 * | 11/2011 | Kawasaki | E02F 9/2075 417/213 |
| 2011/0268590 | A1 * | 11/2011 | Stein | F01B 15/06 417/298 |
| 2012/0076670 | A1 | 3/2012 | Rampen et al. | |

FOREIGN PATENT DOCUMENTS

| | | | |
|---|---|---|---|
| EP | 1537333 | A1 | 6/2005 |
| EP | 1717446 | A2 | 11/2006 |
| EP | 2 246 565 | A1 | 3/2010 |
| EP | 2 211 058 | A1 | 7/2010 |
| JP | 05-240145 | A | 9/1993 |
| JP | 2011-502230 | A | 1/2011 |
| WO | 91/05163 | A1 | 4/1991 |

* cited by examiner

METHOD AND DEVICE FOR ACTUATING AN ELECTRICALLY COMMUTATED FLUID WORKING MACHINE

CROSS REFERENCE TO RELATED APPLICATIONS

This application is entitled to the benefit of and incorporates by reference subject matter disclosed in the International Patent Application No. PCT/DE2013/100340 filed on Sep. 23, 2013 and German Patent Application No. 10 2012 109 074.2 filed Sep. 26, 2012.

TECHNICAL FIELD

The invention relates to a method for actuating a preferably electrically commutated fluid working machine. The invention further relates to a control device for actuating a preferably electrically commutated fluid working machine. Furthermore, the invention relates to a fluid working machine, in particular to an electrically commutated fluid working machine.

BACKGROUND

Fluid working machines are currently used in industry for an extremely wide variety of fields of application. Very generally, fluid working machines are used when fluids have to be pumped or fluids are used to drive a fluid working machine when said fluid working machine is operated in a motor mode. In this way, it is also possible, for example, for mechanical energy to be transported from one location to another with the "interposition" of a fluid circuit.

In this case, the term "fluid" can refer both to gases and also to liquids. It is also possible for the "fluid" to be a mixture of gases and liquids. A fluid can also be understood to mean a supercritical fluid in which a distinction can no longer be made between the gaseous and the liquid state of aggregation. Moreover, it is also harmless for a liquid and/or a gas to carry along a certain proportion of solids (suspension or smoke).

A first field of application of fluid working machines involves partially increasing the pressure level in a fluid to a considerable extent. Examples of fluid working machines of this kind are air compressors or hydraulic pumps. A fluid can also be used to generate mechanical power, wherein pneumatic motors or hydraulic motors are generally used.

An often used type of fluid working machine involves one or more working chambers, which have a cyclically varying volume during operation, being used. In this case, at least one inlet valve and at least one outlet valve are available to each working chamber.

The type of fluid working machine which has been most widely used in the prior art to date has been so-called passive valves in the case of the inlet valves and outlet valves. Said valves open when there is a pressure difference in the passage direction, whereas they close when there is a pressure difference counter to the passage direction. The passive valves are usually also preloaded, so that they close automatically in the normal state (for example spring-loaded valves).

If passive valves of this kind are used, for example, in a fluid pump, they are designed such that a fluid inlet valve opens when the volume of the associated working chamber increases. As soon as the volume of the working chamber decreases again, the fluid inflow valve closes while the fluid outflow valve opens. In this way, fluid is pumped "in one direction" owing to the cyclical fluctuations in volume of the working chamber.

In the case of electrically commutated fluid working machines, at least one of the passive fluid valves is replaced by an electrically actuable valve. In English, fluid working machines of this kind are sometimes known by the term "synthetically commutated hydraulic machines" or "digital displacement pumps". Electrically commutated fluid working machines of this kind are described, for example, in European patent application EP 0 494 236 B1 or international patent application WO 91/05163 A1.

If, for example in the case of an electrically commutated hydraulic pump, the passive fluid inflow valve is replaced by an electrically actuable valve, it is possible for the inflow valve to (initially) be left in the open position when the working chamber begins to decrease in size. As a result, the fluid contained in the working chamber is conveyed back into the fluid reservoir without "real" work being performed. The fluid which has remained in the working chamber is pumped in the direction of a high-pressure line via a passive fluid outflow valve only when the electrically actuable inflow valve is closed by an electrical control pulse. By virtue of this particular design, it is possible for the stream of the hydraulic oil which is "effectively" pumped by the electrically commutated hydraulic pump to be changed to a considerable extent extremely quickly and, in particular, from one pump stroke to the next. This in turn has the advantage that no fluid buffers have to be provided and generally no fluid which is under high pressure has to be discharged in "unused" form via safety valves. As a result, synthetically commutated hydraulic pumps of this kind can sometimes operate considerably more economically than conventional working pumps.

If both the fluid inflow valve and also the fluid outflow valve are replaced by electrically actuable valves, a hydraulic motor which can be regulated very rapidly can also be realized.

Different methods and algorithms have been described in order to match the flow of fluid which is conveyed by an electrically commutated fluid pump (the same applies analogously in the case of a fluid motor) to the flow of fluid currently required in each case.

By way of example, European patent application EP 1 537 333 B1 has described a method in which a certain flow of fluid is generated by full-stroke pumping modes, part-stroke pumping modes and idle-stroke pumping modes being realized in succession, wherein the actually required delivery quantity is provided on average. In order to realize sufficient smoothing, a high-pressure buffer volume is provided, this buffer volume, however, having a smaller volume than conventional hydraulic pumps. Whereas the part-stroke pumping modes are carried out with a fixed pumping volume of always approximately 17% in EP 1 537 333 B1, the method described in said document is refined in EP 2 246 565 A1. Said document (initially) proposes permitting substantially any desired partial volumes for the part-stroke pumping modes. Particular volume ranges are ruled out only when the fluid flow rate through the inflow valve is too high, in order to prevent the development of noise and/or premature wear of the inflow valve and/or of the electrically commutated hydraulic pump. Specifically in the case of the method proposed in EP 2 246 565 A1, a suitable algorithm is used to calculate not only the pumping quantity of the immediately following working strokes, but a plurality of immediately imminent working strokes are also precalculated at a certain time. The quality of the generated flow of fluid is generally better as a result. In particular, residual pulsations can be further suppressed.

Although electrically commutated hydraulic pumps have now reached an entirely respectable state of development, there is still a requirement for further improvements. In particular, a current objective of research is to make electrically commutated hydraulic pumps even smaller and lighter, to reduce the purchasing and operating costs further and to further reduce the energy required by said hydraulic pumps—in particular the electrical energy required by said hydraulic pumps.

SUMMARY

Therefore, the object of the present invention is to propose a method for actuating a fluid working machine, which method is improved in comparison to methods known from the prior art for actuating fluid working machines. A further object of the invention is to propose a control device for fluid working machines, which control device is improved in comparison to controllers known from the prior art for fluid working machines. A further object of the invention is to propose a fluid working machine which exhibits improved properties in comparison to fluid working machines known from the prior art.

The invention achieves these objects.

Said invention proposes carrying out a method for actuating a fluid working machine, wherein the fluid working machine has at least one working chamber with a cyclically varying volume, a high-pressure fluid connection, a low-pressure fluid connection, at least one electrically actuable valve for actuably connecting the high-pressure fluid connection and/or the low-pressure fluid connection to the working chamber, and wherein the at least one electrically actuable valve is actuated depending on the fluid requirement and/or the mechanical power requirement, in such a way that the at least one electrically actuable valve is actuated at least temporarily additionally depending on the electrical power which is required for actuating the at least one electrically actuable valve. In other words, the proposed method may be a method for actuating an electrically commutated fluid working machine, wherein at least one electrically actuable valve (in particular a fluid inlet valve and/or fluid outlet valve for at least one working chamber) is actuated at least temporarily additionally depending on the electrical power which is required for actuating the at least one electrically actuable valve. In the previous developments, the main focus when actuating the electrically commutated fluid working machine was on a flow of fluid which was as advantageous as possible (in the case of operation as a hydraulic pump) or on the mechanical power generated (in the case of operation as a hydraulic motor). No further consideration was given to "side-effects" in the process. "An exception" was made in this respect only in cases in which unacceptable operating noise and/or intolerably increased mechanical wear occurred due to particularly unfavorable actuation patterns. Now however, the inventors have found to their own surprise that the electrically commutated hydraulic pumps have now reached a state of development in which the power which is required for operating the electrically actuable fluid valves can play a significant role to some extent. In order to be able to very quickly and precisely switch the electrically actuable fluid valves, significant electric currents are specifically required, and therefore a corresponding electrical power is required for operating said fluid valves. Accordingly, a corresponding electrical power has to be provided by correspondingly dimensioned generators, for example in the case of mobile operation (forklift trucks, vehicles, utility vehicles, excavators and the like). An internal combustion engine once again serves to drive the generator for example. In this case, the required electric current may well have an important influence on the fuel consumption. However, furthermore, generators, batteries which may be used for temporary buffer storage and, in particular, also the power electronics system which is used to actuate the electrically actuable valves have to be of correspondingly large dimensions, so that (substantially) any desired actuation patterns for the electrically actuable valves can be generated. To date, the components in question have been dimensioned such that it was possible for all electrically actuable valves to be actuated at the same time, this requiring correspondingly large dimensioning (while in reality safety margins usually were taken into consideration). However, the inventors have found that a particularly large proportion of the electrically actuable valves only rarely has to be actuated at the same time in conventional applications. Therefore, a significant load range of the dimensioning of previous electrically commutated fluid working machines is used only rarely to never. Accordingly, it is possible, in principle, to be able to dimension the corresponding components to be smaller, without the operating behavior being adversely affected or problems occurring more frequently and/or noticeably when used in practice. By way of example, it is possible to dimension the components in such a way that only up to 50%, 60%, 70%, 75%, 80%, 85%, 90% or 95% of the electrically actuable valves can be actuated at the same time. The corresponding savings in weight and volume of the components in question usually not only have a "direct" influence, but in particular also an "indirect" influence in the process since, for example, less mass has to be accelerated during mobile operation. As a result, even the electrically commutated fluid working machine in its entirety may be designed to be smaller. In order to be able to realize the described underdimensioning, the inventors further proposed that the electrical power which is required for actuating the at least one electrically actuable valve is at least temporarily additionally taken into consideration when actuating the at least one electrically actuable valve of the fluid working machine. This information can be taken into consideration, in particular, to the effect that the actuation pattern is modified in such a way that certain deviations from the quantity of fluid/mechanical power currently required are (in particular also temporarily) tolerated. As an alternative or in addition, it is also possible for, in particular temporarily, a higher residual fluctuation of the generated quantity of fluid or of the mechanical power and/or, in particular temporarily, a higher development of noise or increased wear of the fluid working machine to be accepted. Initial experiments have shown that entirely respectable reductions in cost, savings in energy and savings in space are possible as a result, usually with an only slight adverse effect on the manner of operation of the electrically commutated fluid working machine. The waste heat which is generated by the power electronics system can moreover also be reduced (and this can also have effects on the dimensioning of heat sinks, fans and the like).

According to a preferred design variant of the method, it is proposed that at least an upper electrical power limit is taken into account, in particular at least one soft electrical power limit and/or at least one hard electrical power limit. A "hard electrical power limit" is to be understood to mean, in particular, a value which must not be exceeded on any account, at least under normal operating conditions. By way of example, said value may be a value which, when it is exceeded, has an adverse effect on the control signals in such a way that sufficiently accurate and/or reliable actuation of the electrically actuable valves is no longer possible. This may also include a case in which, for example, a control electronics system (or parts thereof) fail and a certain time (for example several seconds) is initially required before "normal operation" can be resumed. A "soft electrical power limit" is to be understood to mean, in particular, a value which may be exceeded under certain operating conditions and/or temporarily (in particular briefly). Said value may be, for example, an electrical power at which the lost heat which is produced in the power semiconductors can no longer be (completely) dissipated, and therefore the corresponding components would be impermissibly heated over time. However, since said components have a certain heat buffer, a situation of a power limit of this kind being briefly exceeded is harmless, provided that enough time is then available to "recover" the components in question.

It is further proposed to carry out the method in such a way that the at least one upper electrical power limit is defined at least temporarily and/or at least partially by at least one part of at least one control device and/or is defined at least temporarily and/or at least partially by the electrical power which is available in the system. A part of at least one control device can be understood to mean, in particular, power semiconductors, electrical resistors, capacitors, other temporary energy storage devices and the like. Said part may be, in particular, components which heat up considerably during operation and/or components which conduct electrical energy and/or may be temporary buffers. Electrical power which is available in the system is to be understood to mean, in particular, electrical power which is provided by components which are situated "outside the electrically commutated fluid working machine". If, for example, an electrically commutated fluid working machine is installed in a forklift truck, said electrical power may be the electrical power which the forklift truck can provide. This electrical power may change, for example, owing to the operating conditions of the forklift truck (for example power requirement by lighting devices, electrical heaters, rechargeable battery with a low state of charge, in particular after not having been used for a relatively long period of time and/or after a start-up process, rotation speed of an internal combustion engine and the like). It goes without saying that the electrical power available in the system is generally also defined by the structure of the "entire device". For example, it is possible to realize valve actuation cycles, which cannot be realized during permanent operation, over a limited time with a temporary energy storage device. The additional power requirement required for this purpose can be briefly drawn from the temporary energy storage device. However, a certain recovery phase for the temporary energy storage device is required thereafter.

It is further proposed to carry out the method in such a way that a plurality of electrically actuable valves is actuated, and the electrically actuable valves are associated with, in particular, different working chambers, wherein the working chambers are preferably arranged with a phase offset in relation to one another and/or a plurality of working chambers which operate in parallel is provided. Especially in cases of this kind, it may be necessary, particularly under certain operating conditions, to actuate a larger number of electrically actuable valves at the same time (wherein "at the same time" can also be understood to mean only partially overlapping actuation pulses and/or actuation pulses which are close to one another in respect of time but are separate). As already mentioned, first measurements have shown that actuation cycles which are "unfavorable" in this way occur only rarely and it is generally possible to cope with tolerable adverse effects or to accept the resulting adverse effects.

One possible design variant of the proposed method is that the valve actuation pattern is calculated using a buffer variable. A fluid requirement is fed into said valve actuation pattern from working cycle to working cycle, for example for each pump cycle, on a "plus side". An expedient and at the same time permissible pump stroke is determined in each case based on the current value of the buffer variable, and the currently actuated pump stroke reduces the buffer variable by the relevant value. As a result, it is possible, in a simple manner, for a (partially) suspended value to be "made up" at a later point in time, and therefore for the required quantity to be ultimately realized. Fluctuations which are produced as a result are generally sufficiently small, and therefore disadvantageous effects are generally not produced or are produced only to a reasonable extent. It goes without saying that the developments already proposed in the prior art, such as the provision of "prohibited regions" and/or calculation for some pump cycles in the future in particular, can also be used for this purpose. In addition or as an alternative, it is possible for, in particular, a certain "excess supply" (for example a pumping capacity for fluid which is increased beyond the required quantity in the case of a pump), to be provided by a corresponding valve actuation pattern in a "critical case", wherein an electrical power limit (in particular a soft and/or a hard electrical power limit) is taken into account with the aid of the valve actuation pattern. The "excess supply" can then be "mechanically destroyed" to a certain extent (for example by (high-pressure) fluid being discharged via a safety valve or the like in the case of a pump. It should be noted here that resorting to an "excess supply" is statistically comparatively rarely necessary. Accordingly, "on balance", increased energy efficiency of the entire system can be produced with a design of this kind.

It is further proposed to carry out the method in such a way that an extrapolation algorithm is used for the value of the buffer variable and/or for the value of the expected fluid requirement and/or for the value of the expected mechanical power requirement. As a result, the method can be carried out in an even more advantageous manner. If it is expected, for example, that the fluid requirement which will presumably shortly be called up will increase, the actuation pattern (at which, amongst other things, the electrical power required for actuating the electrically actuable valve/the electrically actuable valves is taken into account) can be selected in such a way that as many boundary conditions as possible are fulfilled as well as possible. If, for example, two different expedient actuation cycles are present (apart from the requirement which will be expected in the future), the variant with which an increasing power requirement can be better satisfied can be selected given a (presumably) increasing power requirement.

It is further proposed to carry out the method in such a way that at least the difference between the fluid requirement and/or the mechanical power requirement and the quantity of fluid actually available after the application of the modification in respect of the electrical power requirement or the mechanical power actually available is determined and is stored, in particular, in an error variable. The error variable can be used, in particular, to carry out suitable correction mechanisms and possibly to allow correction mechanisms which are "undesired" per se when it is expected that the error variable will otherwise increase excessively. However, it is also possible for the error variable to substantially correspond to the buffer variable already described above or to substantially coincide with said buffer variable. In every case, the necessary fluid requirement or the necessary mechanical power requirement can be better and more accurately satisfied with the proposed design.

It is further proposed to carry out the method in such a way that, in particular when a determined value of the error variable is exceeded, particular correction methods are used and, in particular, otherwise impermissible partial pump quantities are permitted. As a result, it is possible for a kind of compromise to be found between fulfilling the requirements in as correct a manner as possible on the one hand and as advantageous an operating behavior as possible on the other (in particular with respect to wear and/or development of noise). Therefore, if, for example, an error were to rise excessively when otherwise usual criteria were used given particularly unfavorable operating conditions, a (usually comparatively low) increase in the operating noise and/or the wear of the fluid working machine can be accepted instead. This is not necessarily harmful since conditions of this kind often occur only rarely and/or for only a short time.

It is also possible to carry out the method in such a way that a plurality of different valve actuation patterns is calculated and stored in advance. In an embodiment of this kind, a comparatively large amount of calculation time can go into creating valve actuation cycles which are as good as possible, in order to realize valve actuation cycles which are as advantageous as possible. Valve actuation patterns of this kind can be stored in large quantities, in a cost-effective manner and given only a small space requirement in electronic memories which are available today. These valve actuation patterns can then be called up depending on the fluid requirement and/or on the mechanical power requirement. Interpolation methods may also possibly be feasible between two stored values and the like. However, it is also possible for a certain number of pump strokes to be calculated "in the future" during operation of the fluid working machine and for the calculated values to be temporarily stored. This can be realized, for example, by "look ahead" algorithms which are known per se.

Furthermore, a control device which is formed and designed in such a way that it at least temporarily carries out a method of the type described above is proposed. A control device which is formed in such a way can then at least in an analogous manner have the advantages and properties already described above in connection with the method proposed above. It is also possible to develop the control device—at least in an analogous manner.

In particular, it is possible for the control device to have at least an electronic memory device, a programmable data-processing device, a semiconductor component and/or a temporary energy storage device. Control devices of this kind have proven particularly advantageous in initial experiments. A temporary energy storage device may be understood to mean, in particular, a capacitor and possibly also a rechargeable battery. In the case of a capacitor, a large capacitance is preferably expedient, as is the case, for example, with so-called gold cap capacitors. A temporary energy storage device of this kind can be used to call up, for example for a brief period of time, an increased electrical power, so that more valves can be actuated to a certain extent for a brief period of time than is permanently possible given the dimensioning of the control device and possibly other components. This can prove to be advantageous.

Finally, a fluid working machine is proposed, in particular an electrically commutated fluid working machine, which is formed and designed in such a way that it at least temporarily carries out a method of the type proposed above and/or has the at least one control device of the type described above. The fluid working machine can then at least analogously have the advantages and properties already described above in connection with the above-described method and/or the above-described control device. Furthermore, the fluid working machine can be (at least analogously) developed as described above.

BRIEF DESCRIPTION OF THE DRAWINGS

The invention will be explained in greater detail below using advantageous exemplary embodiments and with reference to the appended drawing, in which.

DETAILED DESCRIPTION

Figure 1:
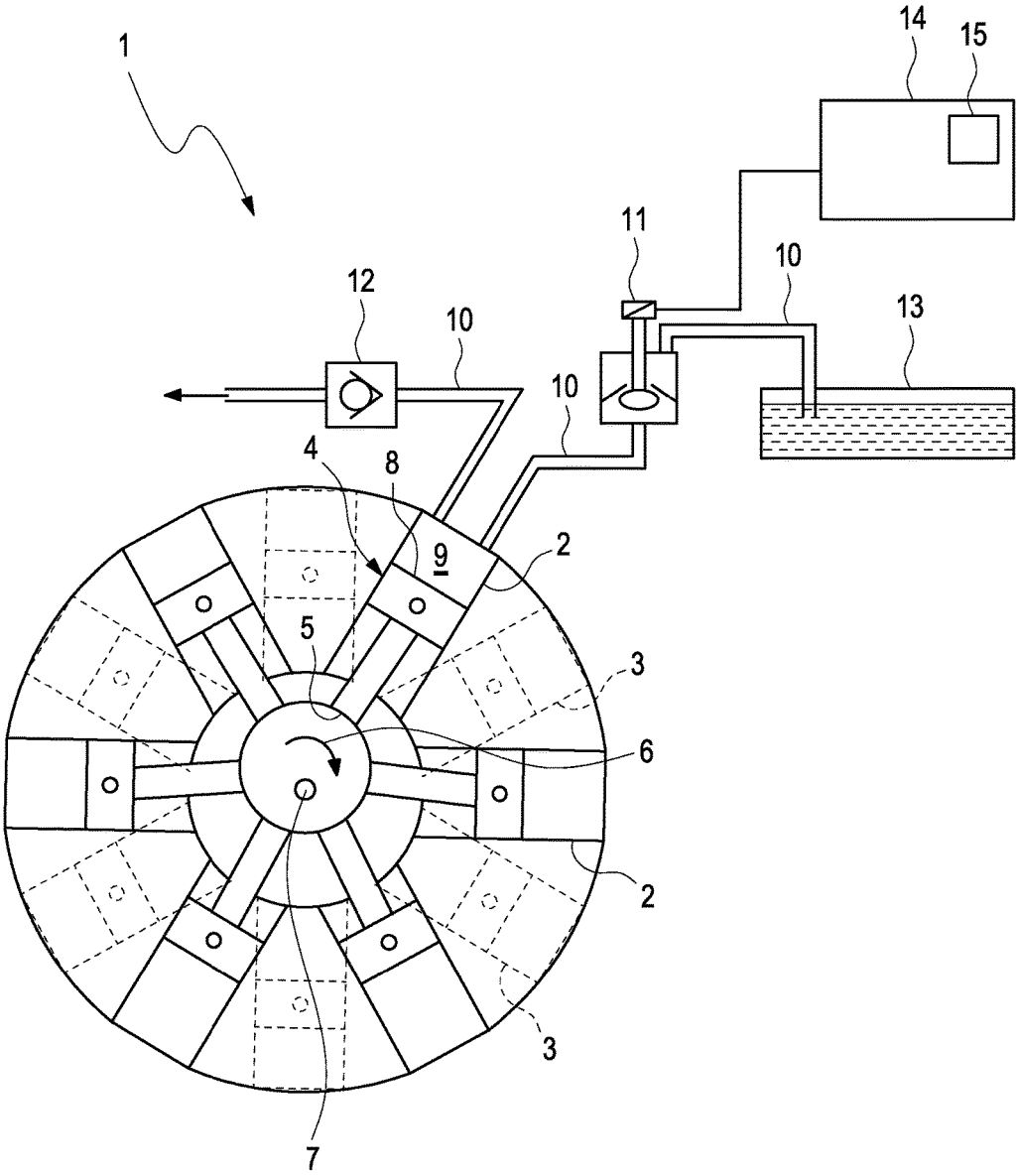
FIG. 1: shows a basic diagram of one possible exemplary embodiment of an electrically commutated hydraulic pump.

FIG. 1 illustrates one feasible exemplary embodiment of an electrically commutated hydraulic pump 1 of the so-called wedding cake type ("wedding cake-type pump"). The hydraulic pump 1 has a total of 12 cylinders 2, 3 which are each arranged spaced apart by an angular distance of 30° from one another. For space reasons, the cylinders 2, 3 are arranged in different planes and, specifically, in the form of two disks which are arranged one behind the other and each have six cylinders 2, 3 in this case. The two disks comprising cylinders 2, 3 are arranged in succession in a direction perpendicular to the plane of the drawing in this case. The respective cylinders 2, 3 are each spaced apart in an angular manner through 60° from one another in each disk. The two disks are each "rotated" through 30° in relation to one another.

Pistons 4 which can each be moved and can each be rotated through a certain angle are arranged in the cylinders 2, 3. The bottom face 5 of the piston 4 is in the form of a sliding sole and is supported on an eccentrically rotating eccentric 6 which is moved around the rotation axis 7. The upper face 8 of the piston 4 forms a fluid-tight closure with the walls of the piston 4. The up-and-down movement of the piston 4, which is caused by the eccentric 6, in the cylinders 2, 3 results in a cyclically varying volume of the pump chambers 9.

Each cylinder 2, 3 is connected to an electrically actuable valve 11, which is connected to a hydraulic oil reservoir 13 for its part, via corresponding hydraulic lines 10. The hydraulic oil reservoir 13 is usually subject to ambient pressure.

Furthermore, each cylinder 2, 3 is connected to a high-pressure collector (not illustrated in the present case) by means of a passive non-return valve 12 via hydraulic lines 10 in the exemplary embodiment illustrated in the present case. In this case, the high-pressure collector can have a high-pressure storage means. However, it is also feasible for a kind of "high-pressure storage function" to be realized, for example, by high-pressure hoses which usually have a certain degree of elasticity. In a case of this kind, it is possible for the high-pressure hoses to pass directly to the hydraulic load (for example to a hydraulic motor).

For illustrative reasons, the hydraulic lines 10, the electrically actuable valve 11 and the non-return valve 12 are depicted only once. The hydraulic oil reservoir 13 and/or the high-pressure collector are/is generally identical for a plurality of and/or for all of the cylinders 2, 3.

The electrically actuable valves 11 are electrically actuated by means of an electronic controller 14. In particular, the electronic controller 14 can have a memory 15 in which a suitable actuation program is stored. The electronic controller 14 can be designed either individually for each electrically actuable valve 11 and/or actuate a portion of or all of the electrically actuable valves 11 of the electrically commutated hydraulic pump 1. The electronic controller 14 may possibly also perform further tasks. In particular, the electronic controller 14 is, for example, a single-board computer which has power semiconductor components which are correspondingly dimensioned for actuating the electrically actuable valves 11.

The manner of operation of an electrically commutated hydraulic pump 1 allows not only a complete pump chamber volume to be "effectively" pumped (that is to say to be moved in the direction of the high-pressure collector), but partial strokes or zero strokes are also possible.

If the piston 4 in the cylinder 2, 3 moves downward, the negative pressure produced opens the electrically actuable valve 11 and hydraulic oil is drawn in by suction from the hydraulic oil reservoir 13 via the hydraulic lines 10 and the electrically actuable valve 11 (low-pressure valve). If the piston 4 reaches the bottom dead center, the passive intake valve would automatically close in a "classic" hydraulic pump. In the case of the electrically commutated hydraulic pump 1 illustrated in the present case however, the electrically actuable valve 11 initially remains open (unless it is actuated in some other way). As a result, the hydraulic oil is initially pushed back into the hydraulic oil reservoir 13 through the still open electrically actuable valve 11, initially without load (and consequently not pumped in the direction of the high-pressure collector). If the electrically actuable valve 11 is now closed after a certain portion of the cylinder path, a pressure builds up rapidly in the pump chamber 9 and the remaining proportion of the volume is "effectively" pumped in the direction of the high-pressure collector by means of the passive non-return valve 12 (high-pressure valve). The described manner of operation corresponds to a partial stroke.

If the electrically actuable valve 11 is closed immediately at the bottom dead center of the cylinder 4, the manner of operation of the electrically commutated hydraulic pump 1 corresponds to a "classic" hydraulic pump (full pump strokes). If, however, the electrically actuable valve 11 is not closed at all, the electrically commutable hydraulic pump 1 is in an idling mode (idling strokes).

With the designs of electrically commutated hydraulic pumps which are customary at present, the electrically actuable valve 11 is closed by applying a relatively large current. If, in contrast, no (or an insufficient) current (or electrical voltage) is applied, the electrically actuable valve 11 remains in the open position. (Designs with an "inverted" switching logic also exist to a certain extent; in a case of this kind, the present description, in particular that illustrated below, should be accordingly adjusted.)

It is clear that the control pulse for closing the electrically actuable valve 11 takes place later the smaller the proportion of volume to be pumped. Therefore, if, for example in the case of two cylinders which immediately follow one behind the other (which are offset, for example, through 30° in relation to one another), a preceding cylinder is intended to generate a partial pump stroke and a following cylinder is intended to generate a full pump stroke, the electrically actuable valves 11 of the two cylinders should be actuated at the same time if the immediately advancing cylinder is intended to generate only a proportion of 93.3% by volume (180° rotation corresponds to 100% pump performance). However, overlapping of different actuation pulses can not only occur in exactly a case of this kind (which presumably would not occur too frequently in reality). Instead, overlapping of this kind can occur considerably more frequently since the signals for closing the electrically actuable valves have to be applied over a certain period of time.

Taking typical values for electrically commutated hydraulic pumps, the required actuation time is 4 ms. Proceeding from a hydraulic pump which operates at 3000 rpm, the duration for a full piston stroke is therefore 20 ms. Therefore, potential overlapping of different actuation pulses of 180°+72° can occur. In an extreme case, simultaneous actuation of up to eight cylinders may occur with the indicated values in a twelve-cylinder pump.

Figure 2:
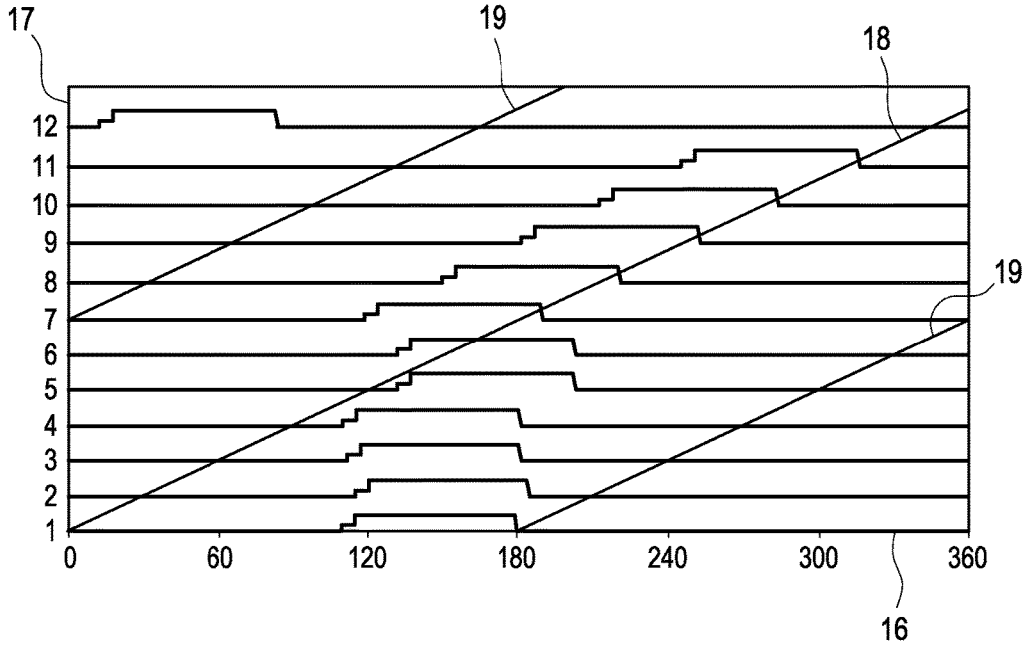
FIG. 2: shows an example of an unfavorable actuation pattern.

FIG. 2 graphically illustrates this effect. In the graph in FIG. 2, the rotation angle 16 (position of the eccentric 6) is illustrated on the abscissa. The actuation currents for the different numbers 17 of cylinders (a total of 12 cylinders) are illustrated on the ordinate. The obliquely running lines 18, 19 shown in the graph correspond to the profile of the respective bottom dead center 18 (beginning of the hydraulic oil ejection phase; pump chamber volume decreases) or the top dead center 19 (end of the liquid ejection phase; pump chamber volume is at the minimum value). The times relate to a 4 ms actuation period and 3000 rpm.

The situation illustrated in FIG. 2 results when the individual cylinders are acted on as follows:
cylinder 1—1%, cylinder 2—10%, cylinder 3—33%, cylinder 4—60%, cylinder 5—66%, cylinder 6—90%, cylinder 7—100%, cylinder 8—100%, cylinder 9—100%, cylinder 10—100%, cylinder 11—100%, cylinder 12—50%. As can be gathered from the figure, eight cylinders are in fact actuated at the same time (specifically cylinders 1 to 8 shortly before "180°"). Some actuation cycles also immediately follow thereafter, and therefore the actuation electronics system (electronic controller 14) does not have much time to recover.

If the electronic controller 14 is now designed for a "worst-case" scenario of this kind, it has to be dimensioned in such a way that it can actuate eight electrically actuable valves 11 at the same time. This is correspondingly expensive and complicated. Furthermore, the electronic controller 14 has to have a corresponding size (installation space). Cooling of the electronic controller 14 also has to be correspondingly dimensioned.

If however, it is simply left "to chance" and the electronic controller 14 is dimensioned in such a way that, for example, only six actuation cycles can be executed at the same time, the current supply would fail at the beginning of the actuation of the last two cylinders (cylinders 6 and 8 in the example illustrated in the present case). This would generally result in not only these two valves no longer being able to close, but furthermore the other valves of the cylinders 1 to 5 and 7 would possibly no longer (fully) close since, for the purpose of starting actuation of the cylinders 6 and 8, these are possibly not yet (fully) closed. A yet further-reaching disadvantage would be that the current supply usually fails in such a way that the electronic controller 14 typically needs one to two seconds recovery time until it is ready to operate again. Behavior of this kind is not tolerable.

It is therefore proposed in the present case for the electronic controller 14 to also take into account the necessary current requirement and to correspondingly adjust the actuation cycles when actuating the electrically actuable valves 11.

If there is, for example, a fluid requirement of 35% (it is assumed below that a pumping interval of between 20% and 80% is "forbidden", and therefore there is no excessive development of noise and/or wear is reduced), this fluid requirement can expediently be generated by three pumping strokes, specifically by the sequence 100%-0%-5% (105% for every three pumping strokes=35% on average).

If the 5% actuation of the "last" cylinder were then to lead to the maximum power of the electronic controller 14 being exceeded, the last pumping cycle is suspended, and therefore the sequence 100%-0%-0% results. This results in an error value of 5% (after the three pumping strokes).

This error value is stored and "balanced" with the fluid requirement. If the fluid requirement remains at 35%, a pumping capacity of 36.67% (110% in the case of three cycles) has to be produced in order to compensate for the preceding shortfall. This can now be implemented by the pumping sequence 100%-0%-10%.

The resulting pumping sequence 100%-0%-0%-100%-0%-10% now corresponds to the required average value of 35%.

Figure 3:
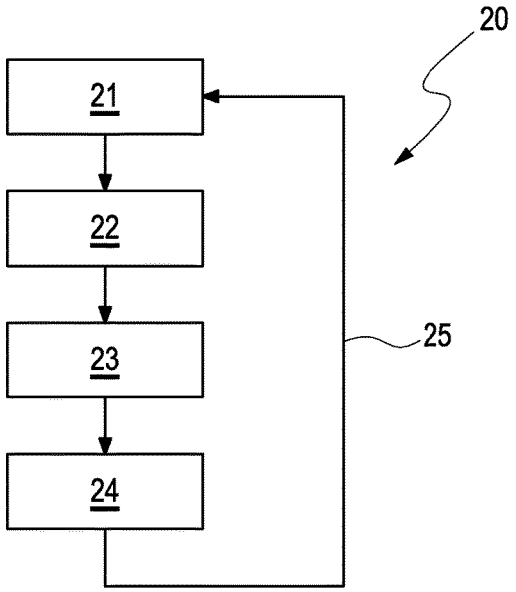
FIG. 3: shows a flowchart for a feasible exemplary embodiment of a method for actuating an electrically commutated hydraulic pump.

Finally, FIG. 3 further illustrates a schematic flowchart 20 which explains a method for actuating an electrically commutated hydraulic pump 1 in greater detail.

In the first step 21, the fluid requirement is read in. In the next step, the read-in fluid requirement is modified taking into account an error parameter (step 22). The error parameter describes the extent to which it was necessary to deviate from the demanded fluid requirement "in the past". Therefore (albeit possibly over somewhat relatively long periods of time), step 22 provides the actually demanded fluid requirement on average.

An actuation sequence for the electrically actuable valves is calculated based on the fluid requirement modified in step 22 (step 23). The necessary electrical power requirement is also taken into account when calculating the actuation sequence. Accordingly, this may result in an actuation sequence which is desired per se in respect of the fluid requirement not being able to be realized since this would lead to the maximum electrical power being exceeded.

The valves are actuated with the actuation sequence obtained in this way (step 24). In parallel with this, the error parameter, which describes the deviation between the actually pumped quantity of fluid and the demanded quantity of fluid, is—if necessary—modified.

After the actuation sequence on the valves has been conducted, the method (arrow 25) returns to the start.

Even though the exemplary embodiment relates to a hydraulic pump, it goes without saying that it is possible for the idea described therein to also be used for a hydraulic motor or for a combination comprising a hydraulic pump and a hydraulic motor.

Although various embodiments of the present invention have been described and shown, the invention is not restricted thereto, but may also be embodied in other ways within the scope of the subject-matter defined in the following claims.

What is claimed is:

1. A method for actuating a fluid working machine, wherein the fluid working machine has at least one working chamber with a cyclically varying volume, a high-pressure fluid connection, a low-pressure fluid connection, at least one electrically actuable valve for actuably connecting the high-pressure fluid connection or the low-pressure fluid connection to the working chamber, comprising the steps of:

actuating the at least one electrically actuable valve depending on a fluid requirement and/or a mechanical power requirement, actuating the at least one electrically actuable valve additionally depending on an electrical power required for actuating the at least one electrically actuable valve, comparing the required electrical power with a soft electrical power limit, a hard electrical power limit or both the soft electrical power limit and the hard electrical power limit, if the required electrical power is compared only to the hard power limit and is greater than the hard power limit, adjusting an actuation cycle of the fluid working machine, if the required electrical power is compared only to the soft power limit and is greater than the soft power limit, actuating the at least one electrically actuable valve, if the required electrical power is compared to both the hard power limit and the soft power limit and is greater than both the hard power limit and the soft power limit, adjusting an actuation cycle of the fluid working machine, if the required electrical power is compared to both the hard power limit and the soft power limit and is greater than the soft electrical power limit and less than or equal to the hard power limit, actuating the at least one electrically actuable valve.

2. The method as claimed in claim 1, wherein the at least one upper electrical power limit is defined by at least one part of at least one control device and/or is defined at least temporarily and/or at least partially by the electrical power which is available in the system.

3. The method as claimed in claim 1, wherein a plurality of electrically actuable valves is actuated, and the electrically actuable valves are associated with different working chambers.

4. The method as claimed in claim 1, wherein a valve actuation pattern is calculated using a buffer variable.

5. The method as claimed in claim 1, wherein an extrapolation algorithm is used for the value of a buffer variable and/or for the value of an expected fluid requirement and/or for the value of an expected mechanical power requirement.

6. The method as claimed in claim 1, wherein at least the difference between the fluid requirement and/or the mechanical power requirement and the quantity of fluid actually available after the application of the modification in respect of the electrical power requirement or the mechanical power actually available is determined and is stored, in an error variable.

7. The method as claimed in claim 1, wherein when a determined value of the error variable is exceeded, correction methods are used.

8. The method as claimed in claim 1, wherein a plurality of different valve actuation patterns is calculated and stored in advance.

9. A control device configured to execute the method as claimed in claim 1.

10. The control device as claimed in claim 9, the control device comprising an electronic memory device, a programmable data-processing device, a semiconductor component and/or a temporary energy storage device.

11. An electrically commutated fluid working machine comprising a control device configured to execute the method as claimed in claim 1.

12. The method as claimed in claim 1, wherein the hard power limit and/or the soft power limit is defined by a control device based on the electrical power which is available in the system.

13. The method as claimed in claim 1, wherein a plurality of electrically actuable valves is actuated, and the electrically actuable valves are associated with different working chambers, wherein a plurality of the working chambers are arranged with a phase offset in relation to one another and/or a plurality of the working chambers which operate in parallel is provided.

14. The method as claimed in claim 2, wherein a plurality of electrically actuable valves is actuated, and the electrically actuable valves are associated with different working chambers, wherein the working chambers are arranged with a phase offset in relation to one another and/or a plurality of working chambers which operate in parallel is provided.

15. The method as claimed in claim 1, wherein a valve actuation pattern is calculated using a buffer variable.

16. The method as claimed in claim 2, wherein a valve actuation pattern is calculated using a buffer variable.

17. The method as claimed in claim 3, wherein a valve actuation pattern is calculated using a buffer variable.

18. The method as claimed in claim 1, wherein the value of a buffer variable is based on an extrapolation algorithm, the value of an expected fluid requirement and/or the value of an expected mechanical power requirement.

19. The method as claimed in claim 2, wherein an extrapolation algorithm is used for the value of a buffer variable and/or for the value of an expected fluid requirement and/or for the value of an expected mechanical power requirement.

20. The method as claimed in claim 3, wherein the working chambers are arranged with a phase offset in relation to one another and/or a plurality of working chambers which operate in parallel is provided.

21. The method as claimed in claim 7, wherein said correction methods comprise permitting otherwise impermissible partial pump quantities.

* * * * *